US005712528A

United States Patent [19]

Barrow et al.

[11] Patent Number: 5,712,528

[45] Date of Patent: Jan. 27, 1998

[54] DUAL SUBSTRATE FULL COLOR TFEL PANEL WITH INSULATOR BRIDGE STRUCTURE

[75] Inventors: William A. Barrow, Beaverton; Carl W. Laakso, Portland; Eric R. Dickey, Beaverton, all of Oreg.

[73] Assignee: Planar Systems, Inc., Beaverton, Oreg.

[21] Appl. No.: 542,476

[22] Filed: Oct. 5, 1995

[51] Int. Cl.[6] ..... H05B 33/14

[52] U.S. Cl. ..... 313/506; 313/505; 313/509; 313/463

[58] Field of Search ..... 313/509, 506, 313/500, 503, 505, 463, 326; 315/169.3; 428/690, 917

[56] References Cited

U.S. PATENT DOCUMENTS 4,396,864 8/1983 Suntola et al. ..... 313/506
4,689,522 8/1987 Robertson ..... 313/505 X
4,719,385 1/1988 Barrow et al. ..... 313/463
4,801,844 1/1989 Barrow et al. ..... 313/509

*Primary Examiner*—Ashok Patel
*Attorney, Agent, or Firm*—Chernoff, Vilhauer, McClung & Stenzel, LLP

[57] ABSTRACT

A full color TFEL display includes stacked panels emitting blue and a combination of red and green light. The panel nearest the viewer employs transparent electrodes on both sides and an insulator bridge structure for the scanning electrodes that alleviates the effect of pinhole defects. The panel farthest from the viewer employs transparent-top electrodes. Each row electrode on the scanning side includes an insulator bridge extending across the panel and then ITO pads extending laterally of the bridge onto the EL stack to form sub pixel points. A bus bar connects all the pixel pads in a row and provides the scanning voltage. The insulator bridge prevents the bus bars from shorting out and permits the pixel pads to fuse open in the event of a short circuit.

12 Claims, 2 Drawing Sheets

DUAL SUBSTRATE FULL COLOR TFEL PANEL WITH INSULATOR BRIDGE STRUCTURE

BACKGROUND OF THE PRESENT INVENTION

The following invention relates to a dual substrate full color thin film electroluminescent (TFEL) display and in particular to a full color display device employing a novel electrode insulator bridge structure to alleviate panel defects and burnout.

One method of achieving full color in a TFEL display is through the use of stacked front and rear independently addressable TFEL panels emitting different colors. In such a display transparent electrodes are used in the front (nearest the viewer) panel to permit light from the rear panel to pass through to the viewer. The pixels in the front and rear panels are aligned but the panels are independently addressable and are separated by a spacer. An example of such a structure is shown in a two-colored TFEL device "MULTI-COLORED THIN FILM ELECTROLUMINESCENT DISPLAY," U.S. Pat. No. 4,719,385. The aforementioned patent provides a dual color display using phosphors of two different colors in each independently addressable TFEL panels.

A full color TFEL display device is shown in Barrow et al. "FULL COLOR HYBRID TFEL DISPLAY SCREEN," U.S. Pat. No. 4,801,844. The full color display screen of the '844 patent employs a rear blue-emitting TFEL panel and a front TFEL panel device having alternating red-and green-light emitting phosphor material patterned in stripes. The front and rear panels are independently addressable. These are passive matrix devices and as such employ mutually orthogonal sets of row and column electrodes sandwiching laminar electroluminescent stacks to create pixel points of light at the intersections of the row and column electrodes. The top or front red and green TFEL panel employs transparent electrodes so that the light from the rear or lower blue panel, which also employs transparent-top electrodes, can be mixed therewith to form three primary colors thereby providing a full color display.

One problem with all such displays is the occurrence of point defects in the electrodes caused by short circuits. Point defects can propagate and cause the electrodes to burn out. This problem is particularly acute with thin transparent electrodes such as those used on the front and rear panels of a stacked dual panel color screen of the type described above. The electrodes must be thin in order to remain transparent, and the material most often chosen, indium tin oxide (ITO), is especially susceptible to burnouts.

Burnouts are not limited to the area of an electrode where the short circuit occurs, but can spread along the entire length of the electrode. Thus, over time, small pin hole defects in electrodes can grow and may cause an entire row or column electrode to become totally inoperative.

SUMMARY OF THE PRESENT INVENTION

The propagation of burnouts is alleviated with the present invention which includes an electrode structure for a thin film electroluminescent device comprising a plurality of elongate insulator bridges extending across a TFEL stack in parallel lines. A plurality of thin pixel pads of conductive material are deposited atop the insulator bridges and extend laterally from the bridges onto areas of the TFEL stack. The pads extend generally coextensively with an electrode array deposited on the opposite side of the TFEL stack to form pixel elements. A plurality of narrow bus bars are placed atop rows of the thin pixel pads and are coupled to driver electronics which supply voltage to that side of the TFEL display.

The bus bars are made up of a sequence of layers of material which is designed to be light absorbing on the side of the bus bars that face the viewer so as to absorb ambient room light and improve the contrast of the display. The bus bars are narrow so as not to interfere with the transmission of light through the panel but are made thick to provide low resistivity for high scanning voltages.

The insulator bridges that lie between the bus bars and the TFEL stack are to prevent electrical breakdown. This is important because, due to the thickness of the bus bar, if an electrical breakdown were to occur, it would likely propagate along the entire length of the bus bar.

The pixel pads lie atop the insulator bridges and extend laterally onto the TFEL stack in alignment with column electrodes on the other side of the stack to form alternating color pixel points. Because of the insulator bridge structure for the bus bar, point defects in the panel which occur at individual pixel pads will be limited to the pad area because the thin ITO used for the pixel pads is likely to fuse open at the edge of the insulator bridge, leaving a defect that occupies only the area of a single pixel.

The electrode structure is especially adapted for use with transparent electrodes on either side of the electroluminescent laminar stack, and as such, the entire structure can be placed in stacked relation with another TFEL device to form a full color TFEL panel.

A full color panel constructed according to the invention includes a first independently addressable electroluminescent panel emitting light of a first color and a second independently addressable electroluminescent panel aligned with the first panel and sandwiched by first and second electrode arrays. The second electroluminescent panel includes a laminar EL stack which emits light of second and third colors wherein one of the electrode arrays comprises elongate electrode members having the insulator bridge structure and the plurality of pixel pads made of a transparent electrically conducting material as described above.

The electroluminescent phosphor material in the second independently addressable EL stack is patterned in stripes which alternate in color-emitting properties. For example, the phosphor stripes may be of electroluminescent material which produce, alternately, red and green light. If desired, green and yellow light-producing phosphors may be used if a red filter is employed in line with the yellow producing phosphor stripes.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
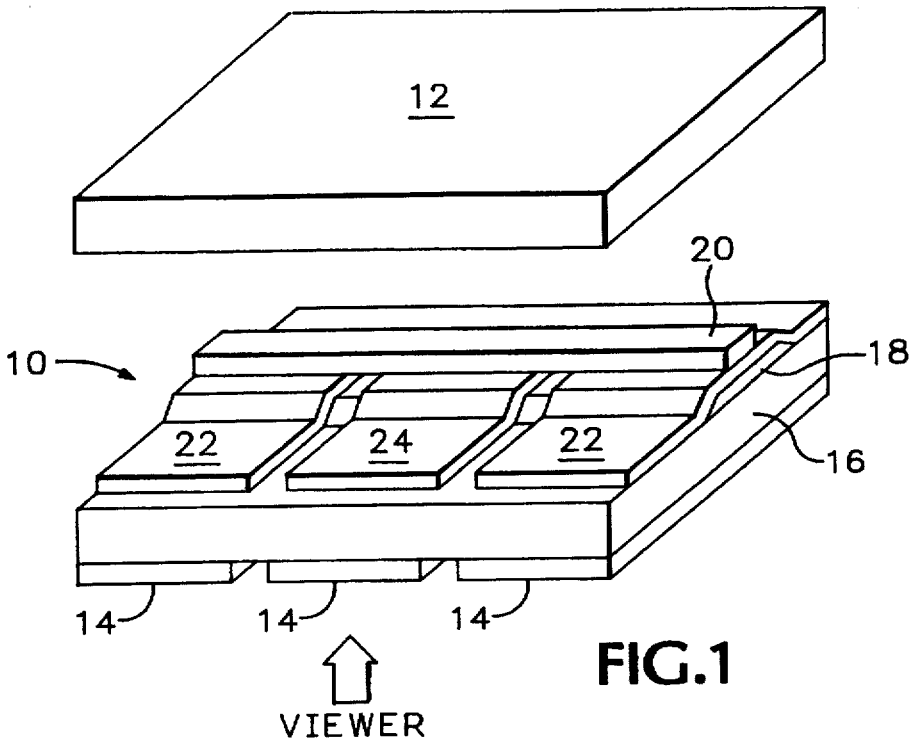
FIG. 1 is a partial perspective view of a portion of a TFEL panel employing the insulator bridge structure of the invention.

An insulator bridge structure for a dual color TFEL device is shown in FIG. 1. A red/green TFEL panel 10 is stacked with a blue emitting TFEL panel 12 to form a full-color display. In this configuration, the blue panes 12 is the rear TFEL device and the viewer is opposite the front (red/green) panel. 10. FIG. 1 shows a portion of the red, green panel 10 in which transparent ITO Column electrodes 14 are nearest the viewer. Underneath the column electrodes 14 is a laminar TFEL stack 16 comprising a green light-emitting phosphor such as ZnS:Tb patterned with alternating phosphor stripes of yellow light-emitting ZnS:Mn. The yellow-emitting patterned phosphor stripes may be filtered to provide red light by using an inorganic CdSSe band edge absorption filter. An inorganic absorption filter is preferred because optical interference filters would be angle-dependent and organic absorption filter would not be able to withstand the thermal processing required in the manufacture of the panel.

Behind the TFEL stack is an insulator bridge 18 which forms a part of the row or scanning electrode structure. The row electrode structure also includes a bus bar 20 and thin ITO pads 22 which are sandwiched between the bus bar 20 and the insulator bridge 18. The insulator bridge is a layer of $SiO_2$ which is 5,000 Å thick. This bridge is designed to be 10 to 20 μm wider than the bus bar 20 to insure that the bus bar 20 remains entirely on the bridge even if layer-to-layer alignment is inaccurate by a few microns. The bridge 18 is tapered so that the thin ITO pads 22, 24 mate with the surface of the TFEL stack 16 without any discontinuity which might otherwise lead to film breakage. The bus bars 20 are made thick enough to provide voltage handling capability with low resistivity, but are made narrow in the viewing direction so as to minimize the amount of light blockage. Preferably, each bus bar 20 is made up of a sequence of layers which are designed to be light-absorbing on the red/green side. The first layer is a 50 Å layer of chromium followed by a 600 Å ITO layer and the balance in aluminum. The surface of the bus bar facing the viewer is thus darkened by applying the layers of chromium, ITO and aluminum in these precise combinations to result in a light-absorbing multi-layer structure which remains electrically conducting.

The thin ITO pixel pads 22, 24 provide scanning voltage to points on the laminar stack 16. These pixel pads 22, 24 are aligned respectively with the patterned phosphor stripes in the TFEL stack 16 so as to produce pixel points of light of alternating colors. Only three such pads are shown in FIG. 1, but it should be understood that the pads alternate across the panel and are aligned co-extensively with the patterned phosphor stripes (not shown) and the column electrodes 14. There will therefore be as many pixel pads per row as there are column electrodes.

Figure 2:
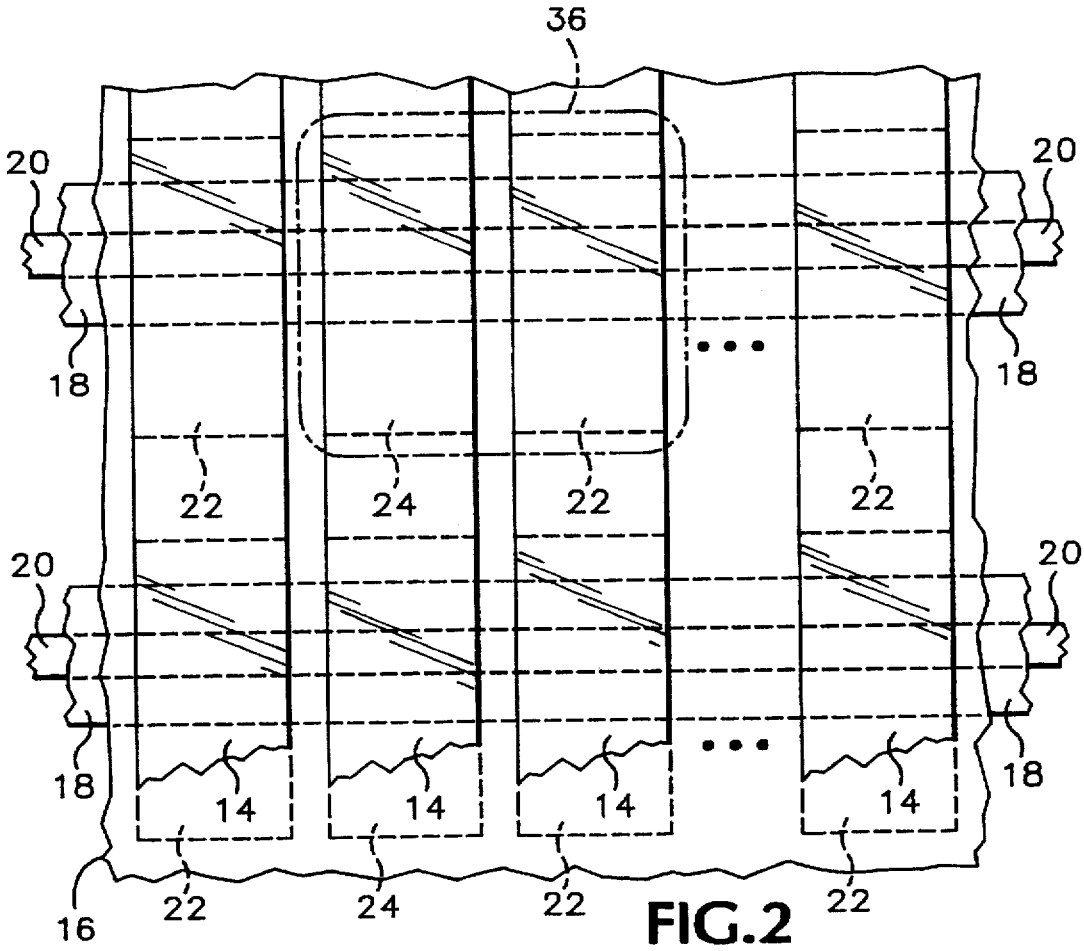
FIG. 2 is a partial top view of a TFEL device employing the insulator bridge structure shown in FIG. 1.

This layout from the viewer's perspective is shown in FIG. 2. The viewer faces a plurality of transparent column electrodes 14. On the opposite side from the viewer are the row electrodes formed by the combination of the insulator bridges 18, the bus bars 20, and the pixel pads 22, 24 shown in dashed outline. It will be appreciated that a single pixel designated by the circle 36 requires two side-by-side pixel pads 22, 24 of alternating colors and the underlying blue light-emitting pixels from the blue panel 12.

Figure 3:
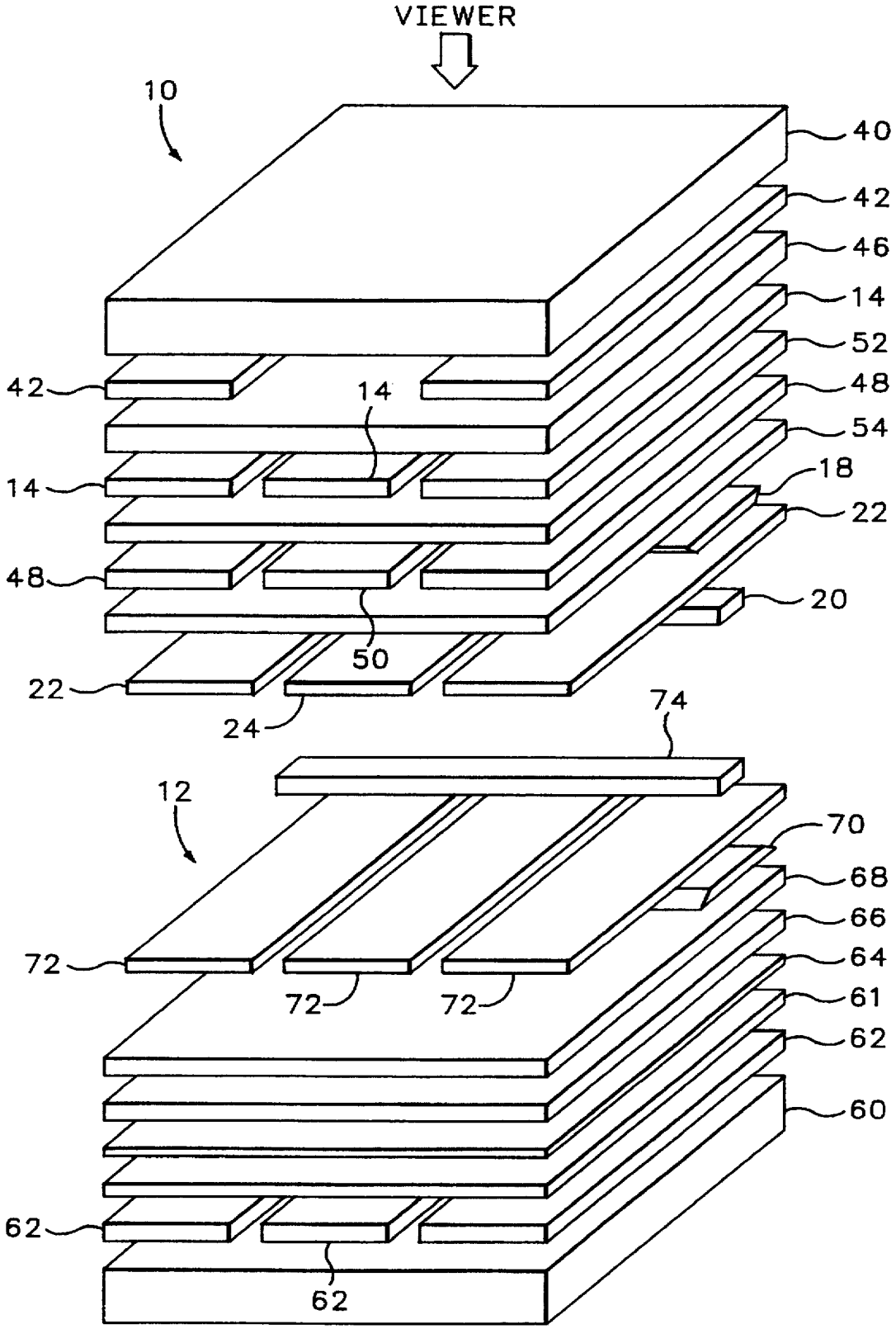
FIG. 3 is a an exploded perspective view of a complete full color TFEL panel employing stacked TFEL devices.

The complete dual substrate structure of the full color panel is shown in FIG. 3. On the viewer's side, the red/green panel 10 is supported by a transparent substrate 40 to which are applied red filters 42 which are aligned with alternating ITO column or data electrodes 14. A barrier layer 46 is interposed between the red filters 42 and the column electrodes 14. The barrier layer is an aluminum oxide layer that isolates the red filters both chemically and electrically from the rest of the panel. An electroluminescent stack is comprised of alternating stripes of yellow phosphor 48 and green producing phosphor 50. The phosphor material is sandwiched between ATO insulator layers 52 and 54. ATO insulators are mixtures of aluminum and titanium oxides produced by atomic layer epitaxy as explained below. The insulator bridge 18 is deposited on the ATO insulator 54 and the ITO pads 22, 24 are deposited atop the insulator bridge 18 and lie flat against the ATO insulator layer 54. The aluminum bus bar 20 is aligned with the insulator bridge 18 sandwiching the edges of the ITO pads 22, 24.

The blue panel 12 is supported by a rear substrate 60. Column electrodes 62 are deposited on the substrate 60 followed by an ATO insulator 61 and a crystallization layer 64. This is a thin ZnS layer that promotes grain growth in the blue phosphor during an annealing phase of panel fabrication. Next, blue phosphor material 66 in the form of a Ce activated, alkaline earth thiogallate is deposited on the crystallization layer 64. An ATO insulator 68 is placed atop the phosphor layer and a row electrode structure is placed atop the insulator to complete the panel. As with the red/green panel 10, the row electrode structure comprises an insulator bridge 70, pixel pads 72 and an aluminum bus bar 74. The pixel pads 72 are aligned and are co-extensive with the ITO column electrodes 62. The aluminum bus bars 74 and associated insulator bridges 70 are aligned in a grid substantially at right angles to the ITO column electrodes 62.

Certain processes are important to making a practical, full-color, dual substrate panel of the type described. The lower insulator 52 of the red/green panel is made by atomic layer epitaxy (ALE). This process is described in a paper entitled, "A Green Emitting Thin Film Electroluminescent Device by Atomic Layer Epitaxy (ALE)." Harkonen, et al., SID 1990, pages 232–235. In addition, a thin ALE wet etch barrier is used in depositing the green light-emitting phosphor material. The barrier between the red and green phosphors is a 600 Å ALE aluminum oxide film. This layer is sufficient to protect the green ZnS:Tb phosphor during wet etch of the ZnS:Mn yellow phosphor which is deposited and patterned immediately after the green. The wet etch barrier must be very thin because it remains behind in the film stack and would increase the voltage threshold too much if it were thicker. The blue panel also employs a bottom ALE insulator and a top ALE insulator. Both are necessary in order to prevent pinhole defects without raising the voltage threshold.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a TFEL display device comprising a laminar electroluminescent stack sandwiched between first and second electrode arrays, an electrode structure for said first one of said arrays comprising:

(a) a plurality of elongate insulator bridges forming rows extending across said laminar stack substantially in parallel;

(b) a plurality of pixel pads of conductive material deposited on each row of insulator bridges and extending laterally from said bridges onto areas of said laminar stack; and (c) a plurality of bus bars connecting the thin pixel pads in each row and extending along said insulator bridges.

2. The electrode structure of claim 1 wherein the second one of said electrode arrays is aligned substantially coextensively with said pixel pads.

3. The electrode structure of claim 1 wherein said bus bars are relatively thick to provide high conductivity and are narrower than said insulator bridges.

4. The electrode structure of claim 3 wherein said bus bars are optically absorbent on at least one side thereof.

5. The electrode structure of claim 1 wherein said first and second electrode arrays are made of optically transparent conductive material.

6. The electrode structure of claim 5 wherein the pixel pads and the second electrode array are made of indium tin oxide.

7. The electrode structure of claim 1 wherein the insulator bridges include tapered edges, said edges extending along a side of the insulator bridges toward the areas of the laminar electroluminescent stack overlaid by the pixel pads.

8. A dual substrate full color TFEL display panel comprising:

(a) a first independently addressable electroluminescent device emitting light of a first color; and (b) a second independently addressable electroluminescent device including first and second electrode arrays, said second electroluminescent device comprising an EL stack emitting light of second and third colors, wherein said first electrode array comprises elongate electrode members coupled to pixel pads of a transparent electrically conducting material extending laterally of said members and coextensive with said second electrode array to form pixel points of alternating second and third colors.

9. The TFEL display of claim 8 wherein said first electrode array includes insulator bridges supporting said pixel pads and interposed between said electrode members and said EL stack.

10. The TFEL display of claim 8 wherein said electrode members comprise bus bars made of a composite metal laminate that absorbs ambient light.

11. The TFEL device of claim 8 wherein said EL stack includes patterned phosphor material emitting the colors yellow and green and said second electroluminescent device further includes red filters visually aligned with said yellow-emitting material.

12. The TFEL device of claim 11 wherein said light of said first color is blue.

* * * * *